US006293576B1

(12) United States Patent
Hunter

(10) Patent No.: US 6,293,576 B1
(45) Date of Patent: Sep. 25, 2001

(54) DOWNHILL SKI WITH TRACTION DEVICE

(75) Inventor: Lemna J. Hunter, Corrales, NM (US)

(73) Assignee: Mechanical Solutions, Inc., Albuquerque, NM (US)

( * ) Notice: Subject to any disclaimer, the term of this patent is extended or adjusted under 35 U.S.C. 154(b) by 0 days.

(21) Appl. No.: 09/314,361

(22) Filed: May 19, 1999

(51) Int. Cl.[7] ..... A63C 7/10

(52) U.S. Cl. ..... 280/604; 280/605; 280/632; 280/28.11

(58) Field of Search ..... 280/602, 607, 280/601, 604, 605, 617, 618, 633, 632, 28.11; 188/5, 8

(56) References Cited

U.S. PATENT DOCUMENTS

| | | | | |
|---|---|---|---|---|
| 4,225,150 | * | 9/1980 | Storandt | 280/605 |
| 4,227,714 | * | 10/1980 | Riedel | 280/605 |
| 4,279,433 | * | 7/1981 | Petaja | 280/605 |
| 4,288,092 | | 9/1981 | Mukri . | |
| 4,596,400 | * | 6/1986 | Stenius | 280/605 |
| 4,674,764 | | 6/1987 | Miesen . | |
| 4,848,785 | * | 7/1989 | Bortoli | 280/605 |
| 4,898,401 | * | 2/1990 | Pau | 280/605 |
| 5,145,200 | | 9/1992 | Humphrey . | |
| 5,356,168 | * | 10/1994 | Ozburn | 280/605 |
| 5,551,721 | * | 9/1996 | Goud et al. | 280/605 |
| 5,642,897 | * | 7/1997 | Couderc et al. | 280/605 |
| 5,735,063 | | 4/1998 | McManus . | |
| 6,007,101 | * | 12/1999 | Pritchard et al. | 280/605 |

* cited by examiner

*Primary Examiner*—Lanna Mai
*Assistant Examiner*—Hau Phan
(74) *Attorney, Agent, or Firm*—Marsh Fischmann & Breyfogle LLP

(57) ABSTRACT

A traction device for a downhill ski is disclosed. In one embodiment the traction device includes a traction member which is pivotally interconnected with the downhill ski. At least one biasing member actively biases this traction member toward a position where at least a portion of the traction member will extend beyond the entire lower surface of the downhill ski. However, the traction member can be retained in a non-traction position by a latch. Appropriate movement of the latch allows the biasing member(s) to pivot the traction member into the desired traction position. The end of a ski pole can be used to activate the latch and initiate movement of the traction member.

20 Claims, 5 Drawing Sheets

DOWNHILL SKI WITH TRACTION DEVICE

FIELD OF THE INVENTION

The present invention generally relates the field of downhill skis and, more particularly, to a traction device for allowing younger and/or less experienced skiers to proceed, via at least some degree of traction, on relatively flat surfaces, on mildly sloped declines, and up mildly sloped inclines such as those which are often encountered between the end of a ski run and the start of the next ski run.

BACKGROUND OF THE INVENTION

Downhill skiing is becoming an ever increasingly family-oriented sport. Younger and younger children are taking up downhill skiing and are demonstrating great abilities in maneuvering down relatively steep inclines, often with little or no fear. However, once gravity stops taking effect at the end of the run, many children and other less experienced skiers struggle on their skis. Children and even some adults often lack the ability to "skate" or "pole" effectively across the flat area or up the slight incline which is typically encountered at the end of the ski run when proceeding to the chair lift. It would be desirable to provide a downhill ski with a simple traction device which could readily be activated by even a child when needed to proceed along a flat surface or up an incline while still on downhill skis.

BRIEF SUMMARY OF THE INVENTION

The present invention generally relates to a traction device for a downhill ski. The downhill ski includes a nose or leading portion which is curved upwardly to a degree. The remainder of the downhill ski or its main body extends rearwardly from the nose at least generally along a reference axis (e.g., having a longitudinal extent). Downhill skis have a main body which is typically significantly longer than it is wide. The main body of the downhill ski may vary in width along its longitudinal extent to a small degree, and its bottom surface may have a slight fore-to-aft curvature or along its longitudinal extent defined as being parallel with the noted reference axis, a slight side-to-side or laterally-extending curvature, or both. A binding is disposed somewhere in the mid portion (although not typically at the longitudinal midpoint) of the main body of the downhill ski on its upper surface. The binding includes a front binding member and a rear binding member which are spaced along the noted reference axis a sufficient distance to accept a downhill ski boot therein. These front and rear binding members may be interconnected and thereby attached as a unit to the ski, or they may be separately attached to the ski. Nonetheless, the downhill ski boot is securely retained within the binding and does not move relative to the ski unless/until the ski boot is removed entirely from the binding (e.g., when the skier falls).

A traction device is provided for the downhill ski. The traction device includes a mount or housing-like structure which is disposed on the upper surface of the main body of the downhill ski and which is appropriately attached to the downhill ski (e.g. through the upper surface of the main body of the downhill ski). The traction device may be positioned forward of the noted binding or rearward of the noted binding. A traction member is disposed along at least one of the sides of the main body of the downhill ski (preferably a traction member is disposed on each of the two sides of the main body of the downhill ski), extends rearwardly from the mount toward the rear end of the downhill ski, and includes a free end which is thereby longitudinally spaced from the mount in the direction of the rear of the downhill ski. A movable interconnection (e.g., pivotal) is provided between the noted traction member and the mount. This movable interconnection allows the noted free end of the noted traction member to move (e.g., pivot) from a position where its free end will not extend beyond the lower surface of the ski (a non-traction position), to a position where its free end will extend beyond the lower surface of the downhill ski (a traction position). At least one biasing member acts on the noted traction member (either directly or indirectly) to bias the free end of the noted traction member to its traction position. However, a latch is provided to prevent the noted traction member from moving from its non-traction position to its traction position until the latch is activated as well.

Various refinements of the above-noted features, as well as additional features, are encompassed by the present invention, individually or in any combination. For instance, another movable interconnection (e.g., pivotal) can be provided between the latch and the mount or an extension thereof such that the latch may move (e.g., pivot) from one position where it is retaining the traction member in its non-traction position (e.g., via a concave holding aperture or "hook", having a "lip" on the latch), to another position where it sufficiently disengages such that the biasing member at least attempts to move the traction member to its traction position (e.g., the biasing member need not be strong enough to extend the free end of the traction member beyond the lower surface of the ski without first picking the ski up off the underlying surface to at least a small degree). The latch may be biased to engage the traction member to retain the same in its non-traction position, or to pivot at least generally in the direction of the portion of the associated traction member which is engaged by the latch when the traction device is in its non-traction position. A ski pole end receptacle or the like may be provided on the latch to allow the same to be activated by inserting the end of the ski pole therein and pushing the latch at least generally away from the engaged portion of the traction member, although a hand or any other mechanism may be used to move the latch in this manner for disengagement of the associated traction member. The latch may also include a ramped surface or the like for interfacing with its associated traction member when in a traction position. When the traction member is moved to push down on this ramped surface of the latch, the latch moves at least generally away from the portion of the traction member engaged by the latch when in a non-traction position, to a position where the latch can then move back toward the noted portion of the traction member to engage the same for retention of the traction member in its non-traction position.

The latch is disposed relative to the mount such that the traction member or an extension thereof may extend beyond the movable interconnection at the mount and at least generally toward the latch for interfacing with the same. The latch may be disposed on either side of the mount to provide this function. In any case, the traction member may be characterized as undergoing a "teeter totter" like effect while pivoting relative to the mount, with the latch acting on one end of the "teeter totter" and with the other end of the traction member being on the opposite end of the "teeter totter". An extension of the traction device may project from the mount in interfacing relation with the ski's upper surface. This extension may have a significantly lower profile than the mount, and provides a surface on which the noted latch may be mounted.

DETAILED DESCRIPTION OF THE INVENTION

Figure 1:
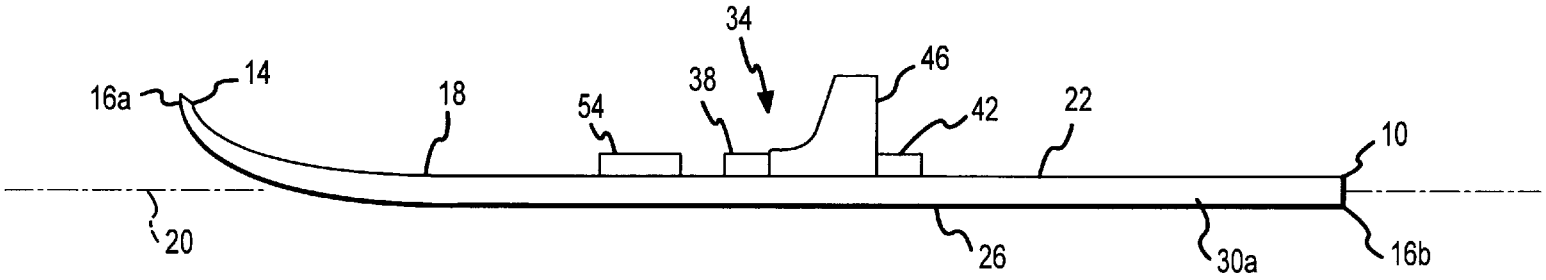
FIG. 1 is a side view of one embodiment of a downhill ski with a traction device generally illustrated thereon in accordance with principles of the present invention.

The present invention will now be described in relation to the accompanying drawings which assist in illustrating its various pertinent features. A downhill ski 10 is illustrated in FIG. 1 which extends at least generally longitudinally along a first reference axis 20 between a pair of longitudinally spaced ends 16*a*, 16*b*. The downhill ski 10 includes an upper surface 22 and a vertically displaced lower surface 26, as well as a pair of laterally displaced (relative to the reference axis 20) side surfaces 30*a*, 30*b*. The majority of the upper surface 22 is typically substantially planar, while the lower surface; 26 may be substantially planar or alternatively may be contoured to a degree to vary the performance characteristics of the downhill ski 10 (e.g., to provide a degree of concavity extending from side 30*a* to side 30*b*).

The downhill ski 10 includes a first member or body 18 which is elongated and which extends at least generally along the noted first reference axis 20. The length of the downhill ski 10 between its ends 16*a*, 16*b* is typically significantly greater than its width between the side surfaces 30*a*, 30*b*. In one embodiment, the downhill ski 10 has a length to width ratio of at least about 8:1. The forward end 16*a* of the downhill ski 10 is defined by a nose 14 which curves upwardly from the body 18 of the downhill ski 10. Therefore, the tip of the nose 14 is vertically displaced from the upper surface 22 of the body 18 of the downhill ski 10.

A binding 34 is disposed on the upper surface 22 of the downhill ski 10 at an intermediate location between its longitudinally spaced ends 16*a*, 16*b*. The binding 34 includes a fore binding member 38 which is rigidly interconnected with the body 18 of the downhill ski 10 (e.g., detachably through one or more fasteners), as well as an aft binding member 42 which is also rigidly interconnected with the body 18 of the downhill ski 10 (e.g., detachably through one or more fasteners). The fore binding member 38 and the aft binding member 42 are longitudinally spaced along the first reference axis 20 to accept a rigid ski boot 46 therebetween. During normal operations of the downhill ski 10, there is no relative movement between the downhill ski 10 and the ski boot 46 because the ski boot 46 is securely retained in the binding 34. However and as known in the art, the binding 34 is set to release the ski boot 46 from the downhill ski 10 in certain situations (e.g., when desired by the skier to remove the ski 10 from the boot 46, in the event of a fall). It should be appreciated that the fore binding member 38 and the aft binding member 42 may be separately attached to the downhill ski 10 or may be part of a single unit which is in turn appropriately attached to the downhill ski 10.

A traction device 54 is also included on the downhill ski 10 of FIG. 1. Each downhill ski 10 of a given pair of skis will preferably have its own traction device 54. Details of the traction device 54 are presented in FIGS. 2–7 and are discussed in more detail below. Generally, the traction device 54 may be activated to allow a user of the downhill ski 10 to proceed in a forward direction with at least some degree of traction. Most often this will be when the skier is attempting to proceed along, a substantially flat surface, down a slightly declined surface, or up a slightly inclined surface. Oftentimes flat and/or inclined surfaces are encountered between the end of a given ski run and the next chair lift. Activation of the traction device 54 will allow the skier to more diligently proceed along these types of surfaces. When the skier reaches the "end" of these types of surfaces, the traction device 10 may be deactivated so as to not interfere with the normal operations of the downhill ski 10. However and as will be evident after a review of the following, any inadvertent activation of the traction device 54 when skiing down the slope should not introduce a significant safety risk.

As clearly shown in FIG. 1, the traction device 54 is disposed at a location which is between the nose 14 of its associated downhill ski 10 and the fore binding member 38 of this downhill ski 10. The traction device 54 will typically be spaced from the fore binding member 38 a sufficient distance so as to not interfere with the operation of the binding 34, but yet still sufficiently close to the fore binding member 38 so as to provide easy access thereto by the skier when activation of the traction device 54 is desired. In one embodiment, the traction device 54 is disposed a distance from the fore binding member 38 (in the direction of the nose 14 and measured along the first reference axis 20) which is within the range of about 2 inches to about 6 inches. Different spacings could be utilized. Furthermore, the traction device 54 could also be mounted behind the aft binding member 42 or more specifically between the aft binding member 42 and the end 16*b* of the downhill ski 10.

Figure 2:
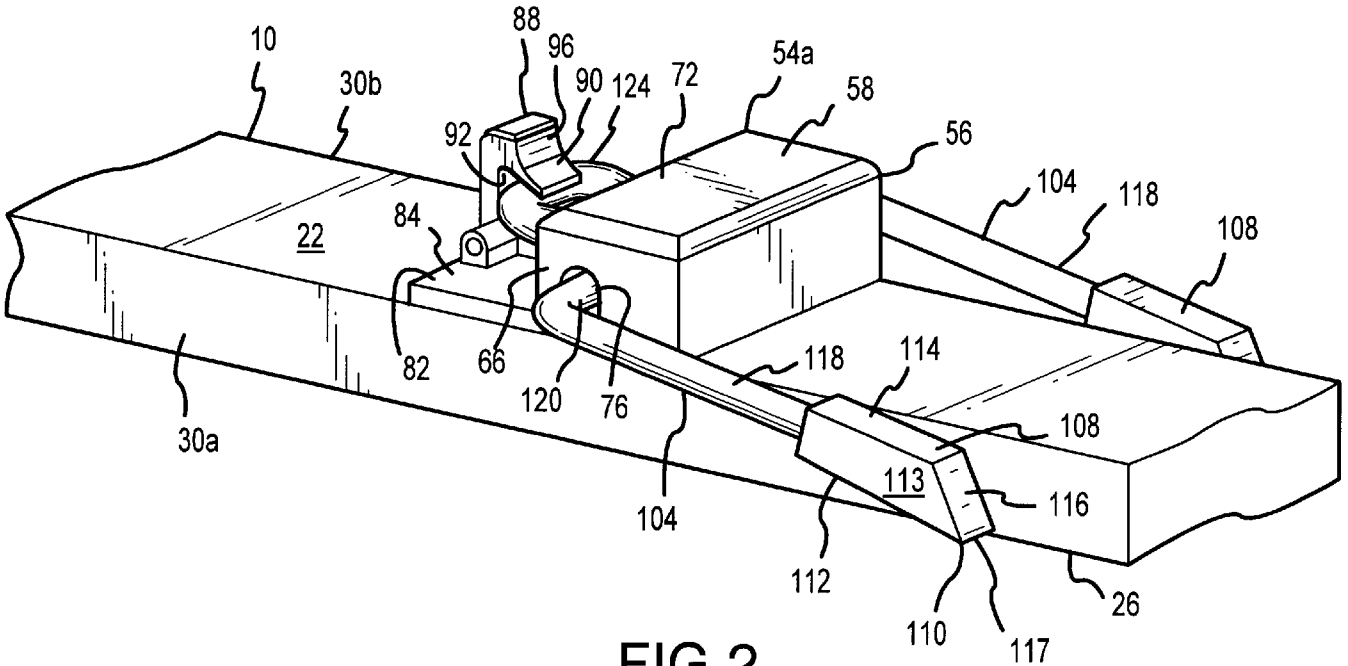
FIG. 2 is a perspective view of the downhill ski of FIG. 1 which illustrates one embodiment of a traction device in more detail and in an inactive or non-traction position.
Figure 3:
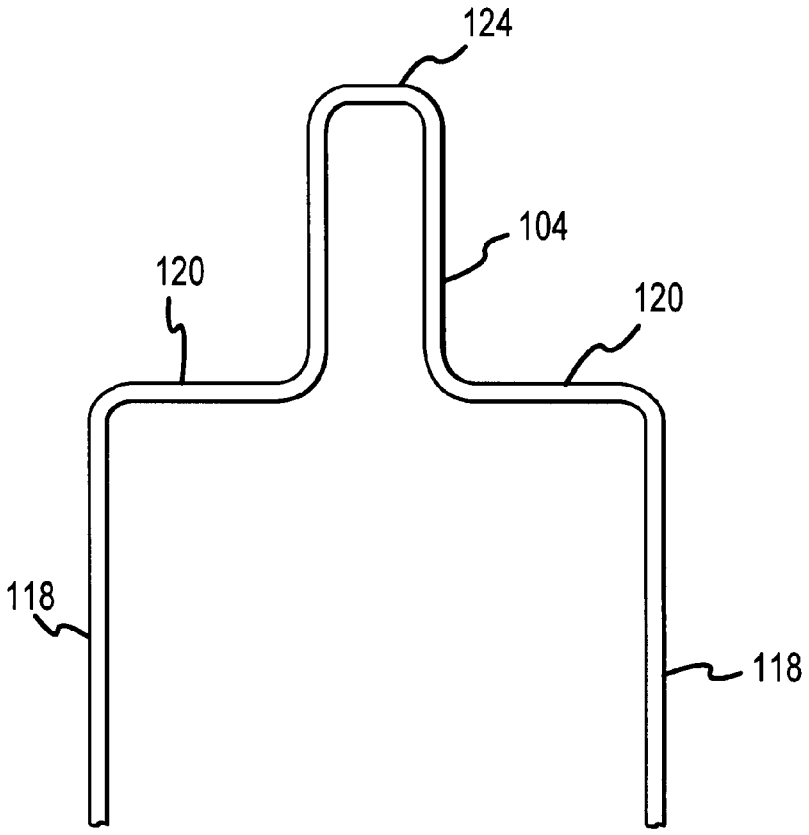
FIG. 3 is a plan view of a traction member of the traction device illustrated in FIG. 2.
Figure 4:
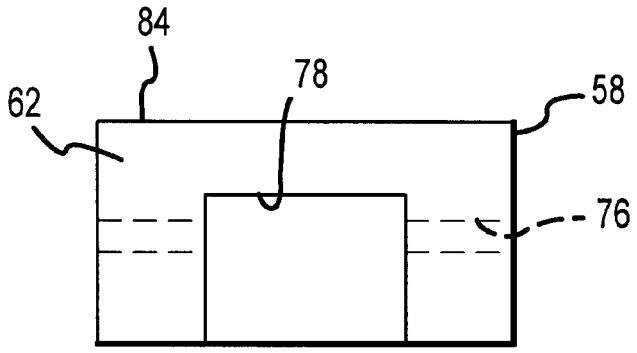
FIG. 4 is a front view of a mount of the traction device illustrated in FIG. 2 which allows for pivotal movement of the traction member of FIG. 3 between an inactive or non-traction position and an active or traction position.
Figure 5:
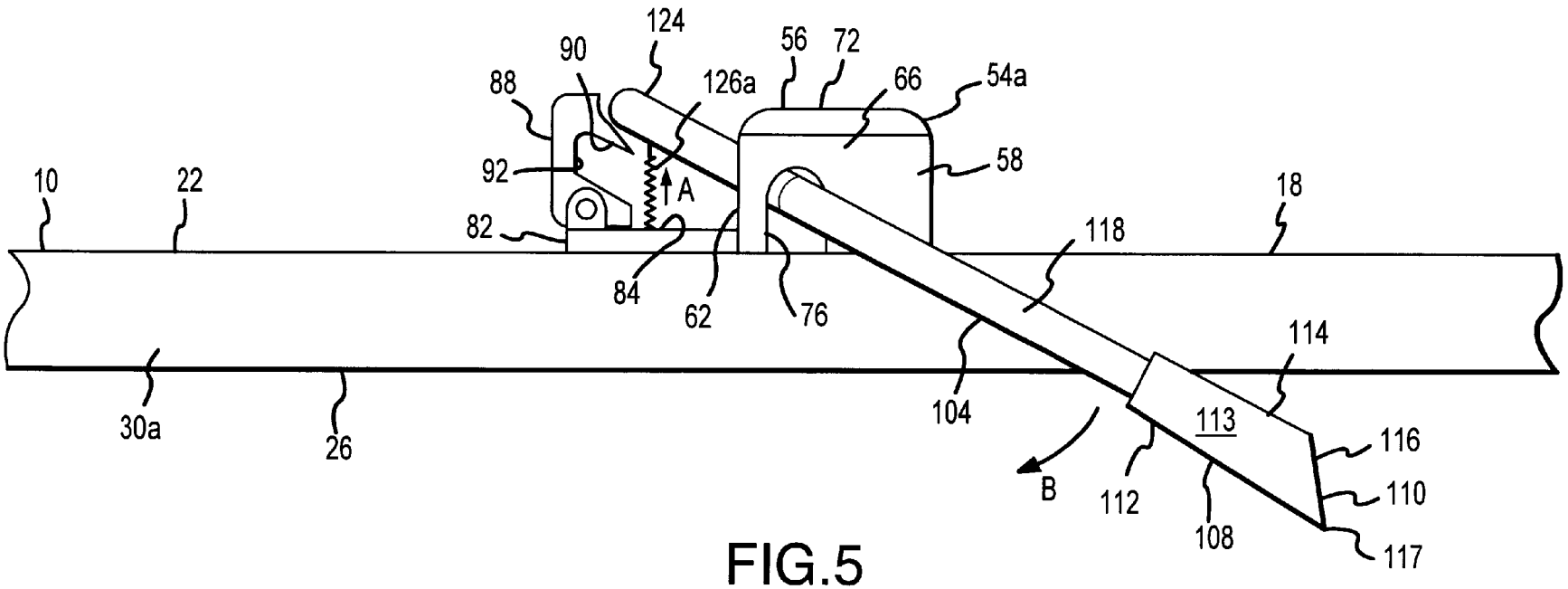
FIG. 5 is a side view of the downhill ski of FIG. 1 with the traction device of FIG. 2 in its active or traction position via one embodiment of a biasing member.
Figure 6:
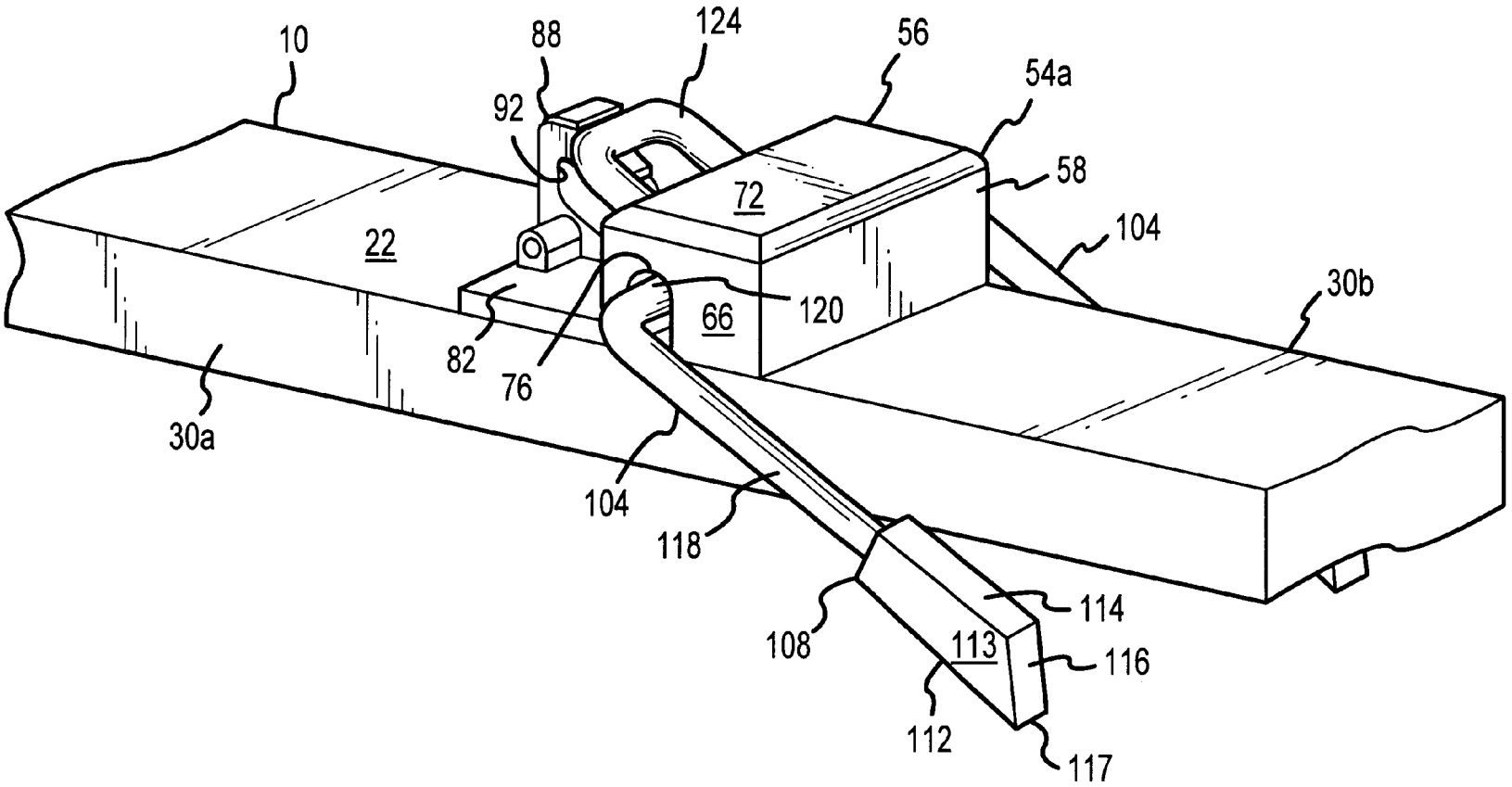
FIG. 6 is a perspective view of the arrangement presented in FIG. 5.
Figure 7:
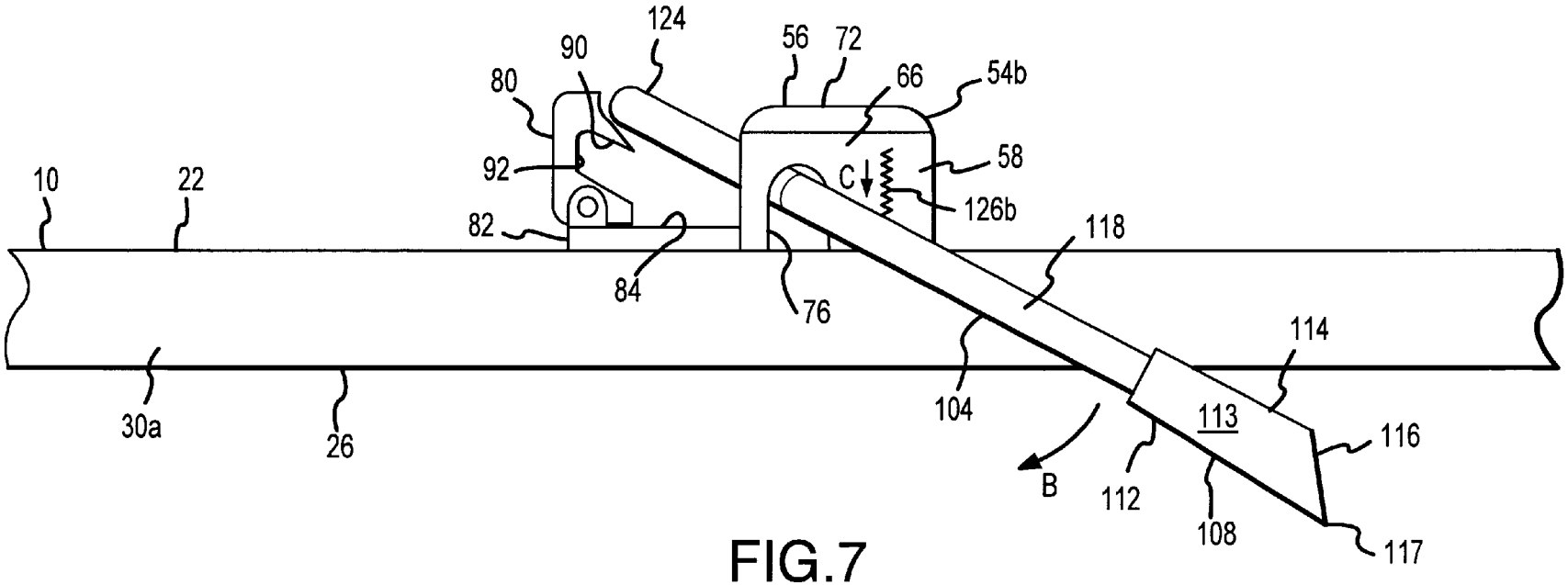
FIG. 7 is a side view of the downhill ski of FIG. 1 with the traction device of FIG. 2 in its active or traction position via another embodiment of a biasing member.

Details of one embodiment of the traction device 54 from the downhill ski 10 of FIG. 1 are presented in FIGS. 2–6 in the form of a traction device 54*a*. The traction device 54*a* generally includes a support structure 56 which is rigidly interconnected with the downhill ski 10, a traction member 104 which is movably interconnected with this support structure 56, a latch 88 which allows the traction member 104 to assume both a traction or active position (FIGS. 5–7) and a non-traction or inactive position (FIG. 2) through movement of the traction member 104 relative to the support structure 56, and at least one biasing member 126*a*, 126*b* which biases the traction member 104 toward its traction or active position (FIGS. 5–7). Referring first to FIGS. 2 and 4, the support structure 56 generally includes a mount 58 and an extension 82. Integral construction of the support structure 56 is contemplated (no joint between the extension 82 and the mount 58), as well as a multiple piece construction (at least one joint between the mount 58 and extension 82). Each of the mount 58 and corresponding extension 82 may be separately attached to the upper surface 22 of the downhill ski 10. Alternatively, by appropriately interconnecting the extension 82 and mount 58 (integrally or one which establishes at least one joint therebetween), it may be possible to only directly interconnect the support structure 56 and downhill ski 10 via the extension 82. Preferably, a detachable interconnection is used between the support structure 56 and the downhill ski 10 (e.g., through one or more fasteners which extend though an upper surface 84 of the extension 82 and into the upper surface 22 of the downhill. ski 10). Moreover, preferably the support structure 56 is no wider than the downhill ski 10 to which it is attached such that it does not extend laterally beyond the side surfaces 30*a*, 30*b* of the downhill ski 10.

The extension 82 is disposed between the mount 58 and the nose 14 of the corresponding downhill ski 10 and has a lower profile than the mount 58 (i.e., an upper surface 72 of the mount 58 extends further from the upper surface 22 of the corresponding downhill ski 10 than the upper surface 84 of the extension 82 extends from this same upper surface 22 of the corresponding downhill ski 10). In one embodiment, the height of the extension 82 is no more than about 0.5 inches above the upper surface 22 of the downhill ski 10. Moreover, in one embodiment the upper surface 72 of the mount 58 is disposed a distance from the upper surface 22 of the downhill ski 10 which is within a range from about 1 inch to about 2 inches. The extension 82 could be disposed on a side of the mount 58 opposite to that illustrated in FIG. 2 to dispose the latch 88 in a position opposite to that shown in FIG. 2.

The traction member 104 is movably interconnected with its corresponding mount 58 for movement between its non-traction or inactive position (FIG. 2), and its traction or active position (FIG. 5) through the action of the biasing member(s) 126*a*, 126*b* which will be discussed in more detail below. Refer to FIGS. 2–3 where it can be seen that the traction member 104 is symmetrical in that it includes a pair of laterally spaced side sections 118, although asymmetrical configurations are possible. Each of these side sections 118 is generally axially extending and one side section 118 is disposed alongside each of the two side surfaces 30*a*, 30*b* of the body 18 of the downhill ski 10. Preferably there is a space between a given side section 118 and the corresponding side surface 30 of the body 18 of the downhill ski 10. In one embodiment, the spacing between a given side section 118 of the traction member 104 and its adjacent side surface 30 (taken perpendicularly to the first reference axis 20) is within a range of about ¼ inch to about ¾ inch.

Disposed on the end of each of the side sections 118 is a head 108 which extends away from its corresponding side section 118 and which defines a pair of free ends 110 for the respective traction member 104. Vertically spaced top and bottom surfaces 114 and 112 define a pair of laterally spaced side surfaces 113 for each head 108. In one embodiment, each of the top surface 114, the bottom surface 112, and the two side surfaces 113 of each head 108 are at least substantially planar. Other profiles may be appropriate. Regardless of the contour of the surfaces, 114, 112, and 113, the length of the top surface 114 may be less than the length of its corresponding bottom surface 112 for each of the heads 108. In this regard, a chamfer 116 interconnects the top surface 114 and its corresponding bottom surface 112 which is also a substantially planar surface in the illustrated embodiment. Other contours may be appropriate. The intersection between the chamfer 116 and its corresponding bottom surface 112 defines a traction edge 117 which is linear in the illustrated embodiment. In one embodiment, length of the traction edge 117 is within a range from about ½ inch to about 1-½ inches. In one embodiment, the angle between the chamfer 116 and its corresponding bottom surface 112 is within a range from about 30° to about 90°. These two traction edges 117 provide a desired interface between the traction member 104 and the surface over which the downhill ski 10 is progressing when the traction devices 54 is in its active or traction position.

Refer now to FIG. 3 where it can be seen that the traction member 104 includes a pair of pivot sections 120 which extend inwardly toward each other from their corresponding side section 118 (toward the first reference axis 20 when the traction device 54 is disposed on the downhill ski 10). These pivot sections 120 are supported within a first aperture 76 which extends laterally through the mount 58 (e.g., FIGS. 2 and 4), preferably perpendicular to the first reference axis 20 but nonetheless in a manner which allows the corresponding traction member 104 to pivot relative to its corresponding mount 58. In one embodiment, the center of the first aperture 76, and thereby a center of the pivot sections 120, is disposed a height above the upper surface 22 of the corresponding downhill ski 10 which is within a range from about ⅛" to about 1".

Extending forward from the pivot sections 120 of each traction member 104 (i.e., in the direction of the nose 14 of the subject downhill ski 10) is a latch interface section 124. Obviously if the latch 88 is disposed on a side of the mount 58 opposite to that illustrated in FIG. 2, the latch interface section 124 would also project in a direction at least generally opposite to that illustrated in FIG. 2. In one embodiment the latch interface section 124 is generally U-shaped. Other profiles may be appropriate. What is important is that there be a sufficient interface between the traction member 104 and its corresponding latch 88 so that the latch 88 can retain its corresponding traction member 104 in a non-traction or inactive position when so desired. In the illustrated embodiment the latch interface section 124 of a given traction member 104 extends through a second aperture 78 of the mount 58. From there it interacts with its corresponding latch 88 to retain the traction member 104 in its inactive or non-traction position (FIG. 2). The second aperture 78 is disposed on the front surface 62 of the mount 58 and extends rearwardly through the mount 58 (e.g., generally in the direction of the end 16*b* of the downhill ski 10) at least generally along the first reference axis 20 for intersection with the noted laterally extending first aperture 76. The height "h" of the second aperture 78 is selected such that the traction member 104 may pivot to its active or traction position for sufficient engagement of the traction edge 117 on the underlying surface. In one embodiment, the distance of the second aperture 78 from the upper surface 22 of the corresponding downhill ski 10 (measured along a line perpendicular to the upper surface 22) is within a range from about ½ inch to about 1 inch.

Although the traction member 104 has been described in multiple sections, it should be appreciated that the two side sections 118, the two pivot sections 120, and the latch interface section 124 may be integrally formed (no joint therebetween, and thereby a continuous structure), or may in fact be formed as separate pieces which are appropriately attached to each other (e.g., by glue, press fit, thermal bond) to define at least one joint between adjacent and separately formed sections). The head 108 may be integrally formed with the remainder of its corresponding traction member 104 (e.g., by molding), or may be separately attached thereto as well. In one embodiment, the head 108 of each traction member 104, its side sections 118, the pivot sections 120, and the latch interface section 124 are formed from materials such as steel or other appropriate metals, nylon, or other plastics. It's possible that a traction member 54 for a child's downhill ski 10 may be formed entirely from nylon or another suitable plastic, and that in an adult unit the side sections 118, pivot sections 120 and latch interface section 124 will be formed from steel or another appropriate metal, with the heads 108 being nylon or another suitable plastic.

The latch 88 of each traction device 54 is disposed forward of its corresponding mount 58, and thereby between its corresponding mount 58 and the nose 14 of its corresponding downhill ski 10 in the illustrated embodiment. However, the latch 88 could be disposed on a side of the mount 58 opposite to that illustrated in FIG. 2. Nonetheless, the latch 88 is pivotally interconnected with the extension 82 to allow the latch 88 to pivot along an axis which is at least generally perpendicular with the first reference axis 20. Although the latch 88 could be directly attached to the upper surface 22 of the downhill ski 10, preferably the extension 82 is used because it reduces the part count and makes for an easier installation.

The latch 88 includes what may be described as a concave holding aperture 92. Appropriate profiles for the concave holding aperture 92 include at least generally U-shaped or C-shaped configurations. Any configuration for the holding aperture 92 which will suitably retain the corresponding traction member 104 in its non-traction or inactive position may be used. More specifically, the latch 88 need only include some type of lip 90 or the like under which its corresponding traction member 104 may be retained, such that the holding aperture 92 is defined by the "concavity" underneath the lip 90.

Transfer of the traction member 104 from its inactive or non-traction position to its active or traction position is provided by moving the latch 88 from the position illustrated in FIG. 2 to the position illustrated in each of FIGS. 5–7. Facilitating this movement of the latch 88 is a ski pole end receptacle 96 which is provided on a surface of the latch 88 which projects at least generally toward the portion of the traction member 104 engaged by the latch 88. That is, the latch 88 may be moved from the position of FIG. 2 to the position of FIGS. 5–7 by disposing a ski pole end in the ski pole end receptacle 96, and at least generally pushing the latch 88 away from the engaged portion of the corresponding traction member 104 (in the direction of the nose 14 of the downhill 10 in the illustrated embodiment). However, the latch 88 may be disengaged in any other manner, such as by hand.

Another function of the ski pole receptacle 96 is that it defines a ramped surface of sorts to facilitate movement of the traction device 54 back to its non-traction position. When the user pushes a given traction member 104 towards its non-traction position, the latch interface section 124 strikes the ski pole end receptacle 96 and forces the latch 88 to rotate away from the latch interface section 124. When the latch interface section 124 clears the lip 90, the latch 88 may be pivoted or rotated back toward the latch interface section 124 to capture the latch interface section 124 under the lip 90 of the latch 88. The latch 88 may be biased toward its "capturing" position by a spring or the like (i.e., biased toward engagement with its corresponding traction member 104).

Further facilitating the transfer of a given traction member 104 from its inactive or non-traction position to its active or traction position is at least one biasing member 124 which exerts an active force on the traction member 104 when being retained in the inactive or non-traction position. One type of biasing member 124 and one location for this biasing member 124 is illustrated in FIG. 5. Here the biasing member 124*a* is disposed forward of the mount 58 (i.e., between the mount 58 and the nose 14 of the corresponding downhill ski 10) and thereby acts on the latch interface section 124 of the traction member of 104 along a line corresponding with the arrow A to bias the traction member 104 for pivoting generally in the direction of the arrow B in FIG. 5. Multiple biasing members 124*a* could be used in the position generally illustrated in FIG. 5, such as by having a biasing member 124*a* acting on each side of the "U" of the latch interface section 124. Appropriate biasing members 124*a* include coil springs, leaf springs, torsion springs, weights, and the like.

Another appropriate location for a biasing member 126 to provide the desired biasing of the traction member 104 to its active or traction position is illustrated in FIG. 7. The traction device 56*b* is identical to that described in relation to FIGS. 2–6 except in relation to the biasing member 126*b*. As such, a "b" designation is used for the device 54*b* of FIG. 7 and the biasing member 126*b*. All other components are similarly numbered. The biasing member 126*b* illustrated in FIG. 7 is disposed on the opposite side of the pivotal axis of the traction member 104 than the biasing member 126*a* in FIG. 5. In this case the biasing member 126*b* exerts a force on the corresponding side section 118 which is at least generally in the direction of the arrow "C" to pivot the traction member 104 in the direction of the arrow B. The biasing member 126*b* could be of the types referenced in relation to the biasing member 126*a* discussed above. Moreover, each side section 118 of a given traction member 104 could have its own biasing member 126*b* to provide symmetrical pivoting forces.

Other types of biasing members could be used, and in locations other than as illustrated in FIGS. 5 and 7. For instance, a leaf spring or the like could be mounted about one or both of the pivot sections 120 and within the first aperture 76 of the mount 58. What is important is that the traction member 104 be actively biased for pivoting in the direction of the arrow B when the traction member 104 is being forcibly retained in its inactive or non-traction position by the latch 88. As such, when the latch 88 is moved away from its corresponding traction member 104 the biasing member(s) 126 will pivot the traction member 104 to its active or traction position.

The traction device 54 is a very simple way to provide a traction function for a downhill ski 10 without interfering with normal downhill skiing operations. When the latch 88 is moved from the position illustrated in FIG. 2 to the position illustrated in FIG. 5, the relevant biasing member(s) 126 exerts sufficient forces on the traction member 104 to pivot the traction member 104 so as to dispose the traction edge 170 below the lower surface 26 of the downhill ski 10 at least when the downhill ski 10 is disengaged from the underlying surface (e.g, when lifting the ski 10 up to a degree). That is, the traction edge 170 will be disposed below the lowermost extreme of the lower surface 26 relative to the upper surface 22 of the ski 10. When the skier then directs the downhill ski 10 back towards the underlying surface and also pushes rearwardly on the downhill ski 10, the traction edge 170 will dig into the underlying snow and/or ice to provide an abutment of sorts which may be pushed against to advance the skier in a forward direction. It is anticipated that pushing rearwardly on the downhill ski 10 while on the traction edge 170 is engaged with the underlying snow and/or ice will actually cause the traction member 104 to further pivot in the direction of its traction position (e.g., to move further in the direction of the arrow B in FIG. 5).

When the downhill ski 10 advances forward and with the traction device 54 of a given ski 10 having been "activated", the traction member 104 should pivot toward its non-traction position at least to some degree. As such, this allows the traction device 54 to remain it is traction position while proceeding to and riding up the chair lift, and when dismounting the chair lift to proceed to the next run. That is, this allows the traction device 54 to be set in its traction position before boarding the ski lift, and alleviates the need for the skier to attempt to set the traction device 54 back to its non-traction position after boarding the ski lift and prior to dismounting from the same. Although having the traction device 54 in its traction position when dismounting the chair lift may induce a little bit of drag, it should not prevent the skier from skiing off of the lift and it may in fact be beneficial by reducing the speed at which the skier proceeds down the incline at the chair lift dismount area and to the flats that are typically encountered before each run. Thereafter, the skier may move the traction device 54 on each ski 10 back to its non-traction position before proceeding down the ski run. However, if the skier forgets to do this or if the traction device 54 is activated during the run, this should still allow the skier to proceed due to the noted pivoting of the traction member 104 toward its non-traction position when the associated ski 10 is proceeding in a forward direction, albeit at a possibly slower speed which may in fact be desirable in some instances.

The foregoing description of the present invention has been presented for purposes of illustration and description. Furthermore, the description is not intended to limit the invention to the form disclosed herein. For instance, other dimensions, materials, and/or configurations may be appropriate. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A winter transport device, comprising:

a first downhill ski comprising an upwardly curved nose and an elongated first member extending rearwardly from said nose at least generally along a first reference axis, wherein said first downhill ski comprises opposing upper and lower surfaces and wherein said first downhill ski comprises first and second side surfaces which define a lateral extent of said first downhill ski;

a first downhill ski binding disposed on said upper first surface which comprises first and second binding members spaced along said first reference axis, wherein said first downhill ski binding member is disposed between said nose and said second binding member;

a first traction device that is disposed at least generally proximate said first downhill ski binding between said first binding member and said nose, and that comprises:

a first mount disposed on said upper surface of said first downhill ski and attached to said first downhill ski;

a first traction member which is positioned at least generally alongside said first side surface, and which comprises a free end which is longitudinally spaced from said first mount in a direction of a rear end of said first downhill ski, wherein said free end comprises a traction edge, wherein said traction edge is oriented so as to provide traction when a user of said first downhill ski exerts a rearwardly directed force on said first downhill ski so as to advance a second downhill ski used by the user in a forward direction;

a first pivotal interconnection between said first traction member and said first mount;

a first biasing member acting on said first traction member, wherein said first biasing member biases said free end of said first traction member toward a position which is disposed below a reference plane which at least generally contains said lower surface of said first downhill ski by pivoting within said first mount;

a first latch comprising first and second latch positions; and a first movable interconnection between said first latch and said first mount, said first latch position retaining said first traction member in a fixed position where said free end of said first traction member is retained above said reference plane, said second latch position allowing said biasing member to bias said free end of said first traction member toward said position which is disposed below said reference plane, wherein said first latch may be moved from said first latch position to said second latch position to allow said first downhill ski to realize at least some degree of traction via said first traction device as an at least generally rearwardly-directed force is exerted on said first downhill ski, all while a rigid downhill ski boot is retained within said first downhill ski binding member so as to not allow relative movement between said rigid downhill ski boot and said first downhill ski.

2. A device, as claimed in claim 1, wherein:

said first movable interconnection comprises a second pivotal interconnection between said first latch and said first mount.

3. A device, as claimed in claim 2, wherein:

a pivotal axis associated with said second pivotal interconnection is at least substantially perpendicular to said first reference axis.

4. A device, as claimed in claim 1, wherein:

said first traction device further comprises a first extension extending from said first mount, wherein said first latch is interfaceable with said first extension.

5. A device, as claimed in claim 4, wherein:

a thickness of said first extension is substantially less than a thickness of said first mount, wherein said first mount is disposed further beyond said upper surface than said first extension.

6. A device, as claimed in claim 4, wherein:

said first movable interconnection comprises a second pivotal interconnection between said first latch and said first mount.

7. A device, as claimed in claim 6, wherein:

a pivotal axis associated with said second pivotal interconnection is at least substantially perpendicular to said first reference axis.

8. A device, as claimed in claim 1, wherein:

said first latch comprises a concave holding aperture which projects toward said upper surface when said first latch member is in said first latch position.

9. A device, as claimed in claim 1, wherein:

said first latch further comprises a first ski pole end receptacle accessible by a ski pole end when said first latch is in said first latch position.

10. A device, as claimed in claim 1, wherein:

said first traction device further comprises a latch interface member which is interconnected with said first traction member and which interfaces with said first latch when said first latch is in said first latch position.

11. A device, as claimed in claim 1, wherein:

said first traction member comprises first and second portions which each extend beyond said first mount at least generally toward said rear end of said first ski when said first latch is in said first latch position, said first portion having a smaller diameter than said second portion and said second portion defining said free end.

12. A device, as claimed in claim 1, wherein:

said free end of said first traction member comprises a chamfered surface.

13. A device, as claimed in claim 1, wherein:

said first traction device further comprises:

a second traction member which is pivotally interconnected with said first mount, which is positioned at least generally alongside said second side surface, and which comprises a second free end which is longitudinally spaced from said first mount in a direction of said rear end of said first ski;

a first end member interconnecting said first and second traction members which extends beyond said first mount, wherein said latch member engages said first end member when said first latch is in said first latch position.

14. A device, as claimed in claim 13, wherein:

said first movable interconnection comprises a second pivotal interconnection between said first latch and said first mount, wherein said second pivotal connection is at least substantially perpendicular to said first reference axis, and wherein said first latch further comprises a concave holding aperture which projects toward said upper surface when said first latch member is in said first latch position.

15. A device, as claimed in claim 14, wherein:

said first latch further comprises a first ski pole end receptacle accessible by a ski pole end when said first latch is in said first latch position.

16. A device, as claimed in claim 14, wherein:

said first latch member pivots at least generally away from said first mount when moving from said first latch position to said second latch position.

17. A device, as claimed in claim 14, wherein:

said concave holding aperture of said first latch is disposed closer to said nose when said first latch is in said second latch position that when said first latch is in said first latch position.

18. A device, as claimed in claim 1, wherein:

said first latch comprises a first inclined surface which interfaces with said first member to move said first latch further in a direction of said second latch position when pivoting said first traction member to dispose said free end of said first traction member above said reference plane and prior to movement of said first latch back to said first latch position.

19. A device, as claimed in claim 1, further comprising:

means for biasing said first latch toward said first latch position.

20. A winter transport device, comprising:

a first downhill ski comprising an upwardly curved nose and an elongated first member extending rearwardly from said nose at least generally along a first reference axis, wherein said first downhill ski comprises opposing upper and lower surfaces and wherein said first downhill ski comprises first and second side surfaces which define a lateral extent of said first downhill ski;

a first downhill ski binding disposed on said upper first surface which comprises first and second binding members spaced along said first reference axis, wherein said first downhill ski binding member is disposed between said nose and said second binding member;

a first traction device that is disposed at least generally proximate said first downhill ski binding at a location such that said second binding member is disposed between said first traction device and said first binding member, and that comprises:

a first mount disposed on said upper surface of said first downhill ski and attached to said first downhill ski;

a first traction member which is positioned at least generally alongside said first side surface, and which comprises a free end which is longitudinally spaced from said first mount in a direction of a rear end of said first downhill ski, wherein said free end comprises a traction edge, wherein said traction edge is oriented so as to provide traction when a user of said first downhill ski exerts a rearwardly directed force on said first downhill ski so as to advance a second downhill ski used by the user in a forward direction;

a first movable interconnection between said first traction member and said first mount;

a first biasing member acting on said first traction member, wherein said first biasing member biases said free end of said first traction member toward a position which is disposed below a reference plane which at least generally contains said lower surface of said first downhill ski by movement of said first traction member relative to said first mount;

a first latch comprising first and second latch positions; and a second movable interconnection between said first latch and said first mount, said first latch position retaining said first second traction member in a fixed position where said free end of said first traction member is retained above said reference plane, said second latch position allowing said biasing member to bias said free end of said first traction member toward said position which is disposed below said reference plane, wherein said first latch may be moved from said first latch position to said second latch position to allow said first downhill ski to realize at least some degree of traction via said first traction device as an at least generally rearwardly-directed force is exerted on said first downhill ski, all while a rigid downhill ski boot is retained within said first downhill ski binding member so as to not allow relative movement between said rigid downhill ski boot and said first downhill ski.

* * * * *